United States Patent [19]

Yarborough, Jr.

[11] 4,380,437

[45] Apr. 19, 1983

[54] SMALL WEAPONS SIMULATOR

[76] Inventor: G. Wirth Yarborough, Jr., 1150 Dauphin St., Mobile, Ala. 36604

[21] Appl. No.: 299,335

[22] Filed: Sep. 4, 1981

[51] Int. Cl.[3] ..... F41F 27/00

[52] U.S. Cl. ..... 434/18

[58] Field of Search ..... 434/18, 16, 21, 22; 273/312

[56] References Cited

U.S. PATENT DOCUMENTS

| | | | |
|---|---|---|---|
| 2,023,497 | 12/1935 | Trammell | 434/21 |
| 2,398,813 | 4/1946 | Swisher | 434/19 |
| 3,220,732 | 11/1965 | Pincus | 273/312 |
| 3,657,826 | 4/1972 | Marshall et al. | 434/22 |
| 3,813,795 | 6/1974 | Marshall et al. | 434/22 |
| 3,938,262 | 2/1976 | Dye et al. | 434/21 |
| 4,302,190 | 11/1981 | Shaw et al. | 434/18 |

OTHER PUBLICATIONS

Radio and Electronics Constructor, pp. 629–631, vol. 32, No. 10, Jun., 1979.

*Primary Examiner*—William H. Grieb
*Attorney, Agent, or Firm*—Ziems & Walter

[57] ABSTRACT

A small weapons simulator in which a plurality of functioning and control modules are supported by a gun body having an exterior configuration to simulate a real weapon. The functioning modules include a laser beam transmitter to synthesize the trajectory of a bullet, recoil simulating means, sound simulating means and means to develop a lifting force on the forward portion of the gun body upon trigger actuation of the trigger, the recoil means and the sound simulating means to synthesize the characteristic of muzzle-rise on discharging a projectile from a weapon.

2 Claims, 5 Drawing Figures

SMALL WEAPONS SIMULATOR

BACKGROUND OF THE INVENTION

This invention relates to weapon simulators and more particularly, it concerns a small caliber weapons simulator in which all physical characteristics exhibited by the firing of a real weapon are synthesized to provide a safe, economical and effective marksmanship training device.

U.S. Pat. No. 3,657,826 issued Apr. 25, 1972 to Albert H. Marshall et al and U.S. Pat. No. 3,938,262 issued Feb. 17, 1976 to Richard A. Dye et al exemplify prior art disclosures of weapon simulators in which a laser beam transmitter is employed to simulate the trajectory of a bullet discharged from a gun. In the Marshall et al patent, the laser beam transmitter is supported within a replica of a gun to be simulated and incorporates circuitry for synthesizing either automatic or semi-automatic operation of a real weapon. The simulator disclosed in the Dye et al patent uses a laser transmitter mounted on a real weapon and actuated in response to blank cartridges fired by the weapon.

While the effectiveness of laser beam transmitters as a safe and economical aid to marksmanship training has been demonstrated by the prior art, there is a need for such a training device which simulates more accurately and completely the physical characteristics experienced by a marksman on firing a real weapon. Such characteristics as gun recoil and the audible report of a bullet discharged from a gun have an influence on the marksman's ability to sight and fire a weapon and should be accounted for in simulators. These characteristics are recognized in such prior art disclosures as U.S. Pat. No. 2,398,813 issued Apr. 23, 1946 to T. H. Swisher and U.S. Pat. No. 3,220,732 issued Nov. 30, 1965 to M. S. Pincus. In addition to recoil and sound, however, the discharge of a bullet from a rifle develops a reaction to initiation of bullet spin known as "muzzle rise" and which is exhibited as a lifting force on the barrel of the weapon. This latter characteristic has an effect particularly on repetitive firing whether resembling an automatic or semi-automatic mode of weapons operation.

SUMMARY OF THE PRESENT INVENTION

In accordance with the present invention, a weapon simulator is provided in which substantially all physical characteristics experienced during the firing of an actual gun are synthesized in a replica of a gun body which supports light transmitting means to represent the trajectory of a bullet. The gun body preferably includes two half-parts to present an exterior configuration resembling a weapon to be simulated and to define interior compartments for supporting light transmitting, recoil, muzzle rise, sound and control modules in a manner to enable use of the same modules in a gun body having differing desired external configurations. The muzzle rise module operates to develop a lifting force, when actuated, to the forward portion of the gun body by issuing a downwardly directed jet of air, for example. All modules are controlled by a common actuator for substantially simultaneous operation to develop the several physical reactions incident to firing a real weapon.

A principal object of the present invention is therefore to provide an inherently safe, economical and effective small weapons simulator for marksmanship training or the like. Other objects and further scope of applicability will be apparent from the detailed description to follow taken in conjunction with the accompanying drawings in which like parts are designated by like reference numerals.

DETAILED DESCRIPTION OF THE PREFERRED EMBODIMENT

Figure 1:
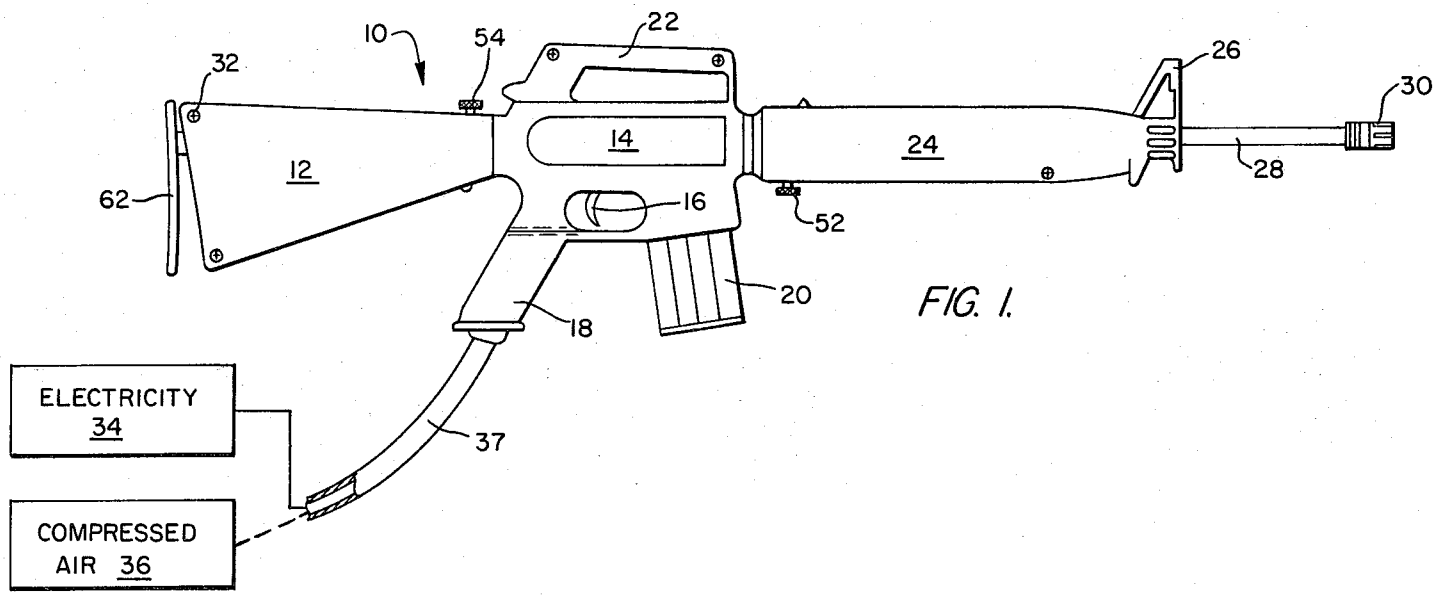
FIG. 1 is a side elevation of a weapons simulator in accordance with the present invention.
Figure 2:
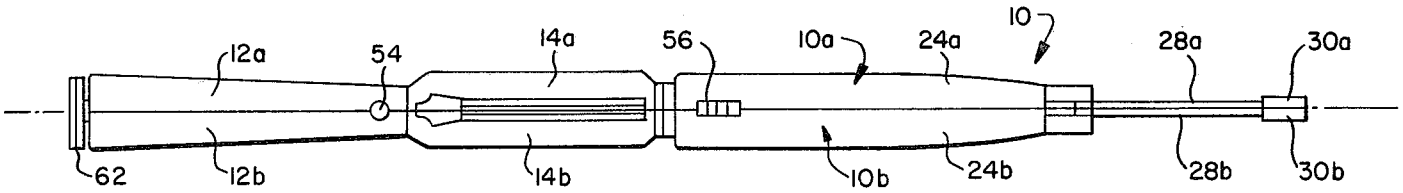
FIG. 2 is a top plan view of the simulator illustrated in FIG. 1.

In FIGS. 1 and 2 of the drawings, the exterior configuration of a gun body replica to be simulated is generally designated by the reference numeral 10. The gun body illustrated in the drawings is intended as a replica of an M-16 rifle and as such includes components representing the exterior configuration of a buttstock 12; an action housing 14 supporting a trigger 16, a trigger handle 18, a magazine 20 and a rear sight 22; a forestock 24 supporting at its front end a front sight 26; and a barrel 28 having a muzzle 30. As may be seen in FIG. 2, the gun body 10 is divided longitudinally into two half-parts 10*a* and 10*b* releasably secured against one another by appropriate means such as screw bolts 32. The parts 10*a* and 10*b* are preferably molded from any of several synthetic resinous or plastic materials capable of presenting an exterior appearance resembling the rifle or small arms weapon to be simulated. Also it is contemplated that the parts 10*a* and 10*b* may be appropriately weighted to simulate the weight and balance of an actual weapon. Further, it should be understood that although the gun body is a replica of the M-16 rifle in the illustrated embodiment, the parts 10*a* and 10*b* may be of a configuration to represent any of several weapons currently in or to be placed in use for military or civilian purposes.

Figure 3:
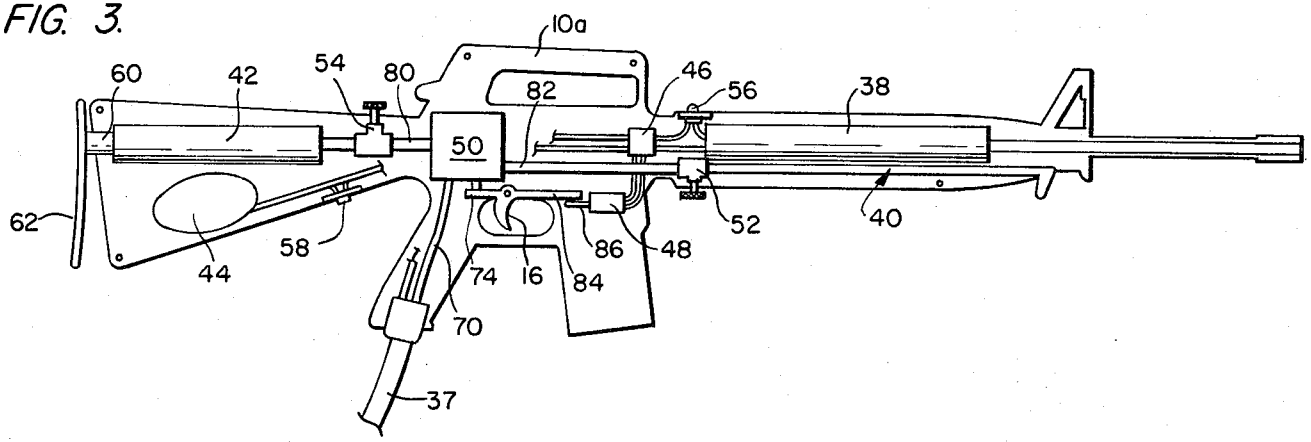
FIG. 3 is a side elevation illustrating the interior of one of the gun body parts included in the simulator illustrated in FIGS. 1 and 2.

As shown in FIG. 3 of the drawings, the gun body parts 10*a* and 10*b* are formed with a plurality of mating compartments to receive various functioning and control modules to be described in more detail below but which, when actuated, simulate the several physical characteristics experienced by a marksman on firing a real weapon. The several modules are operated by an external source of power which, in the illustrated embodiment, includes a source of electric power 34 and a source of compressed air 36, both of which are connected by a combined conduit 37 to the interior of the gun body preferably at the base of the trigger handle 18.

The functioning modules supported by complmentary compartments in the gun body 10 include a laser beam transmitter module 38 and muzzle rise module 40 supported in the forestock 24 together with a recoil module 42 and a sound producing module 44 supported in the buttstock 12. Control modules supported in the action housing 14 include an electric module 46, an actuating switch module 48 and an air valve module 50. The several functioning modules are adapted to be actuated in substantially simultaneous fashion by movement of the trigger 16. In addition, each of the functioning modules may be placed in an active or inactive state by override controls including shut-off valves 52 and 54 for the muzzle rise and recoil modules, respectively, and master switches 56 and 58 for the respective laser beam transmitter 38 and sound module 44.

The laser transmitter 38 may be of the type disclosed in the above mentioned U.S. Pat. No. 3,675,826 or of a low power helium-neon laser available under the designation selectron SEL-05 from Selectro-Scientific Inc. of Sunnyvale, California. The associated circuit module 46 may include pulsing circuitry as disclosed in U.S. Pat. No. 3,675,826 in order to simulate semi-automatic or automatic rifle operation. Preferably, the laser beam transmitted by the module 38 is on the axis of the tubular barrel 28 of the gun replica 10.

The recoil module 42 is a pneumatic cylinder and piston arrangement, the piston (not shown) acting against an anvil 60 and butt plate 62 projecting at the end of the buttstock 12. A typically preferred piston cylinder unit for use as the recoil module 42 is a model AA Utica Pneumatic 137 available commercially from Chicago Pneumatic of Utica, N.Y. As such, the module preferably includes a cycling valve (not shown) by which the module will develop a single impulse when supplied with compressed air for a short duration of time or will develop repetitive impulses with air supply over a longer duration.

Figure 5:
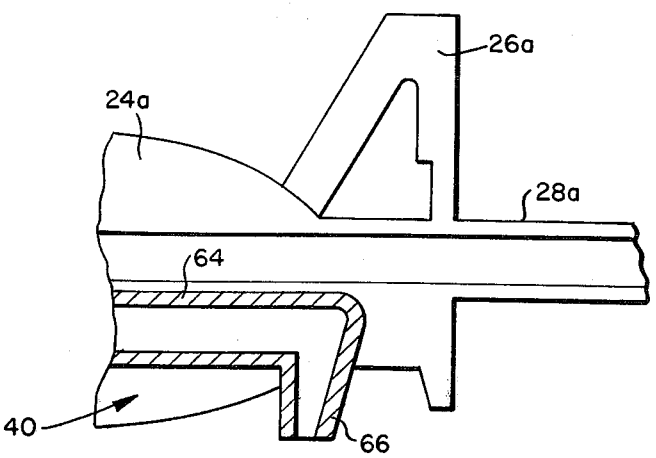
FIG. 5 is an enlarged fragmentary cross-section illustrating an embodiment muzzle rise module.

As shown in FIGS. 3 and 5, the muzzle rise module 40 in the disclosed embodiment includes a tubular conduit 64 terminating in a downwardly directed nozzle 66 which is located under the forward end of the forestock 24 in the illustrated embodiment. The acceleration of compressed air through the nozzle 66 will develop a lifting force effective at the front end of the forestock and in the region of the barrel 28.

Figure 4:
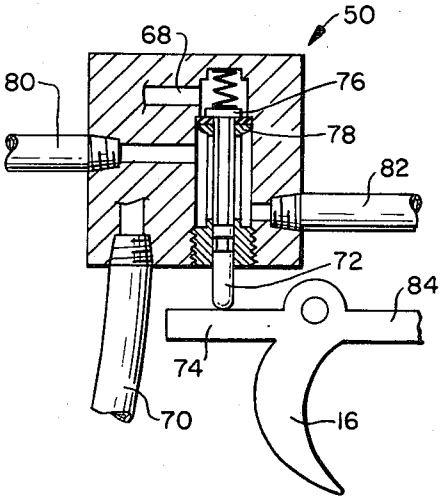
FIG. 4 is an enlarged fragmentary cross-section illustrating a control module of the invention.

In FIG. 4, details of the air control valve 50 are shown to include air inlet porting 68 in fluid communication with the source of compressed air 36 through the conduit 37 and a tube 70 extending from the conduit within the gun interior to the air control valve 50. A valve actuating plunger 72 overlies a rearwardly extending lever arm 74 on the trigger 16 to be lifted to unseat a valve body 76 from a seat 78 when the trigger 16 is pivoted in a clockwise direction as shown in FIG. 4. Unseating of the valve body 76 will establish fluid communication between the inlet porting 68 and outlet conduits 80 and 82 extending respectively to the recoil module 42 and the muzzle rise module 40.

The sound module 44 includes a conventional audio speaker actuated under the control of the switches 48 and 58. In this respect the circuit module 46 includes appropriate electronic circuitry (not shown) for actuating the module 44 to simulate the report of a rifle on firing a bullet. As may be seen in FIG. 3, a forwardly extending arm 84 on the trigger 16 engages an arm 86 on the switch module 48 also upon clockwise pivotal movement of the trigger 16.

In operation, with the gun body connected to the source of electricity 34 and compressed air 36 it may be operated in the manner of a real weapon by sighting a target and squeezing the trigger 16. Upon squeezing movement of the trigger 14, the laser transmitter module 38 is energized to transmit a beam at a target to simulate the trajectory of one or more bullets. Simultaneously with each energizing pulse of the laser transmitter 38 to simulate the trajectory of a bullet will be accompanied by a recoil generated by the module 42, an audible report from the module 44 and a lifting effect on the forestock 24 by a jet of air issuing from the nozzle 66. In the event it is desired to deenergize any one of the functioning modules 38, 40, 42 or 44, this may be accomplished by actuation of either valve 52 or 54 or switch 56 or 58.

Thus it will be seen that as a result of the present invention, a highly effective small weapons simulator is provided by which the stated principal objective, among others, are completely fulfilled. It is contemplated and will be apparent to those skilled in the art from the preceeding description that various modifications and/or changes may be made in the illustrated and described embodiment without departure from the present invention. Accordingly, it is expressly intended that the foregoing description and accompanying drawings are illustrative of a preferred embodiment only, not limiting, and that the true spirit and scope of the present invention be determined by reference to the appended claims.

I claim:

1. A small weapons simulator for marksmanship training, said simulator comprising:

a gun body having an external buttstock, action housing, forestock and muzzle configuration resembling a weapon to be simulated;

a transmitter supported within said body for transmitting a light beam forwardly along the barrel axis of said body;

recoil means supported within said body to develop a rearwardly directed force impulse when actuated, said recoil means comprising a pneumatic piston-cylinder module;

muzzle rise simulating means for developing a force upon actuation to lift the forward portion of said body; and means for simultaneously actuating said transmitter, said recoil means and said muzzle rise means, said actuating means comprising means defining a supply of compressed air to said gun body and trigger actuated valve means for actuating said piston-cylinder module.

2. The apparatus recited in claim 1 wherein said muzzle rise simulating means comprises a downwardly directed nozzle projecting from said forestock, and means for delivering a pulse of compressed air through said nozzle upon actuation of said valve means.

* * * * *